US005497702A

United States Patent [19]

Gorter

[11] Patent Number: 5,497,702

[45] Date of Patent: Mar. 12, 1996

[54] INK CHAMBER DOCTOR BLADE FOR AN INKING UNIT

[75] Inventor: Cornelis Gorter, Wapenveld, Netherlands

[73] Assignee: Namic B.V., Netherlands

[21] Appl. No.: 94,003

[22] PCT Filed: Nov. 21, 1992

[86] PCT No.: PCT/EP92/02684

§ 371 Date: Aug. 16, 1993

§ 102(e) Date: Aug. 16, 1993

[87] PCT Pub. No.: WO93/10975

PCT Pub. Date: Jun. 10, 1993

[30] Foreign Application Priority Data

Nov. 26, 1991 [DE] Germany ..... 41 38 807.0
Apr. 28, 1992 [DE] Germany ..... 9205695 U

[51] Int. Cl.[6] ..... B41F 31/06; B41F 31/08

[52] U.S. Cl. ..... 101/366

[58] Field of Search ..... 101/157, 169, 101/365, 366, 363, 364, 207–210; 118/261, 259, 410, 411

[56] References Cited

U.S. PATENT DOCUMENTS

| | | | |
|---|---|---|---|
| 4,358,561 | 9/1990 | Grosshauser et al. | 101/366 X |
| 4,643,127 | 2/1987 | Wanke | 118/413 |
| 4,688,516 | 8/1987 | Sommer | 118/410 |
| 4,834,018 | 5/1989 | Sollinger et al. | 118/410 |
| 4,903,632 | 2/1990 | Sollinger | 118/123 |
| 4,920,913 | 5/1990 | Knop et al. | 118/410 |
| 5,031,529 | 7/1991 | Greenwood | 101/366 |
| 5,054,392 | 10/1991 | Greenwood | 101/169 |

FOREIGN PATENT DOCUMENTS

| | | |
|---|---|---|
| 0368485 | 5/1990 | European Pat. Off. . |
| 3446525 | 8/1985 | Germany . |
| 350950 | 2/1961 | Switzerland . |

*Primary Examiner*—J. Reed Fisher
*Attorney, Agent, or Firm*—Webb Ziesenheim Bruening Logsdon Orkin & Hanson

[57] ABSTRACT

An arrangement for coating continuous material webs is designed in particular as an inking cell doctor blade for an ink transfer, circular cylindrical screen, such as a screened roller or an engraved cylinder of a printing machine. In the cavity of the inking cell is arranged a profiled body with a pressure nose spaced apart from the outer surface of the screen which forms a flow gap that extends in the axial direction in relation to the screen. The pressure nose further has a relief located behind the screen in its direction of rotation, for a sudden cross-sectional enlargement that causes a sudden pressure drop in the part of the cell cavity located behind the pressure nose. When the circular cylindrical screen is rotated, a high pressure builds up in the wedge-shaped, narrowing flow gap between the pressure nose and the outer surface of the screen. This high pressure presses the liquid printing ink into the cups or recesses located at the circumference of the screen and constantly swirls it therein, so that ink residues and impurities are constantly washed out of the cups and/or recesses and mixed with the supplied printing ink.

25 Claims, 5 Drawing Sheets

INK CHAMBER DOCTOR BLADE FOR AN INKING UNIT

FIELD OF THE INVENTION

The invention concerns a device for coating moving strips of material and relates in particular to an ink chamber doctor blade for an inking, screened circular cylindrical body such as an engraved roller or gravure inking cylinder on a printing press.

PRIOR ART

Amongst known single-chamber doctor blades, the ink in the lower part of the ink chamber is conveyed either to the centre or to both ends of the chamber and then flows into the ink duct in longitudinal direction parallel to the engraved roller while being swirled by the rotating engraved roller, then being again removed in the upper part of the ink chamber. The single-chamber doctor blade has a positive blade and a negative blade which scrapes off the surplus paint in the upper part of the ink chamber while the engraved roller rotates at a circumferential speed of e.g. 100 r.p.m.

A disadvantage with this is that the very numerous small cups in the engraved roller gradually fill up with ink residues and old printing ink in the course of time and can then no longer adequately take up new printing ink, so that the printing quality deteriorates quite appreciably. Engraved rollers must therefore be brushed down and cleaned with highly aggressive media at regular, brief intervals, e.g. weekly, which with the extremely small screen separation of the cups is highly labour-intensive if thorough cleaning is to be achieved.

In addition, with the known single-chamber doctor blade, a high pressure builds up in the ink chamber at higher circumferential speeds of the engraved roller through which the upper negative blade may arch outwards in the rotatory direction of the roller so that the knife edge of the negative blade no longer lies flush along the circumference of the roller, but is tilted slightly, resulting in a kind of aquaplaning effect lifting the edge of the blade from the circumference of the roller so that the ink is no longer completely cleaned from the bridges between the screen cups.

In addition, it should be noted that liquid ink is composed of solvents and solid particles in addition to other components. These solid particles, used for pigmentation, are certainly intimately mixed with the solvent, yet solid particles may be separated from the solvent by centrifugal force which results in a change in color.

This risk is due especially to uncontrolled swirling of the ink in the doctor blade box, which is the greatest at the inlet to the ink chamber on the doctor blade box and we assume different dimensions between the inlet duct and the outlet duct before again stabilizing only before the outlet duct.

Further, with the known ink chamber doctor blades, whether a cup on the engraved roller is filled with fresh ink or not when passing the doctor blade box is largely left to chance. Gaps in the printed image are the result. This applies analogously also to ink chamber doctor blades with a gravure roller on gravure presses and to chamber doctor blades with engraved roller for the uniform application of thin layers of adhesive on carrier foil or strip material or for applying thin magnetic coatings to magnetic tapes e.g. for tape recorder or video cassettes.

An ink chamber doctor blade of the type first mentioned is known from DE 37 37 531 A1 which is designed as a forme cleat for a flushing inking mechanism on a rotary press. A moulding is fitted in the ink distribution chamber on this inking cleat between two doctor blades, around which the ink can flow freely and which can pivot or rotate. By this means, by creating a uniform ink flow without turbulence, uniform contact is possible between the ink and the inking roller at high circumferential speeds and an ink flow pressure can be adjusted for better filling of the cups on the inking roller. The moulding has an elliptical cross section. Tilting the moulding around its axis of rotation therefore produces a change of the smallest gap width, the gap being formed by the engraved roller and the surface area of the moulding facing the roller. The strength of the ink in the gap is at its greatest shortly in front of the smallest gap width seen from the direction of the engraved roller. According to a formula indicated, a change in the smallest gap width therefore results in an immediate [word illegible] in the ink on the engraved roller. The moulding is tilted by adjusting devices fitted in each case on the outside of the lateral guards of the inking cleat. The adjustment can be made by hand or by a servo-motor.

The moulding may with this known inking cleat also have a wing profile or consist of two opposing concave surfaces, whereby, however, the gap width is again gradually increased after each narrowing of the gap width between the moulding and the surface of the engraved roller and a corresponding gradual relaxation is consequently created in the liquid ink pressed into the cups on the engraved roller after passing through the engraved roller in rotating direction behind the moulding. The ink is compressed only slightly in the cups on the engraved roller through the narrowing of the gap width and is subsequently not suddenly again relaxed, so that the parts of the ink present in the cups are not replaced by new ink. A special cleaning and ink exchanging effect is not therefore produced by narrowing the gap width alone.

With another known inking mechanism an ink chamber with a lower inlet and an upper outlet between two doctor blades is certainly known with a narrowing in the rotating direction of the engraved roller towards the ink outlet in order to improve the inking on letter-press rotary presses (DE-Zeitschrift ifra zeitungstechnik, September 1989, pages 1–5), but with this known inking device, too, the narrowing is so formed that no sudden pressure drop occurs in the rotating direction of the engraved roller beyond the narrowing. The ink present in the cups on the engraved roller is consequently not further swirled after passing through the narrowing in the ink chamber before the passage through the negative doctor blade arranged behind it in the rotating direction of the engraved roller.

In a further known coating device for coating moving strips of fabric with a coating slip (DE 34 46 757 A1) a guide is certainly fitting in the rotating direction of the engraved roller between an inlet for the coating slip and a doctor blade element adjoining the coating chamber which, however, is at some distance from the engraved roller and consequently can neither increase nor reduce the print in the coating mass at the guide as it passes along the engraved roller.

In a further known chamber doctor blade for rotary presses (DE 38 23 340 C1) at least one additional doctor blade is fitted within the ink chamber, whereby the additional doctor blade knife/knives may in the working position of the doctor blade chamber device be adjusted against the coating roller without necessarily touching the latter. The additional doctor blade knife may also be a damping rod blade which will, however, lift from the circumference of the coating roller as pressure builds up on the blade side.

A device for coating strips of material running across a back-up impression cylinder with adjustable coating thickness and an apportioning chamber is known from CH 663 362 A5, in which a return lip is adjustably fitted in such a way that a pre-apportioning gap formed by the return lip to a pre-apportioning chamber facilitates the creation of a blocking jet directed contrary to the circulating direction of the strip of material. This is intended to prevent the creation of an air boundary layer in the apportioning chamber with the circulating strip of material at very high speeds.

The purpose of the invention is to improve a coating device especially in the form of an ink chamber doctor blade as claimed in claim 1 by simple technical means in such a way that the ink is more effectively swirled and mixed through in the cups at the circumference of the screened or engraved cylindrical body on passing through the ink chamber so that the cups are filled uniformly with new ink on each passage through the ink chamber and depositing of solid particles from the printing ink in the cups is largely prevented and the printed image on printed products produced on flexographic presses is consequently also quite appreciably improved in the long run.

This problem is solved in a generic coating device according to the invention which is hereinafter described in greater detail.

SUMMARY OF THE INVENTION

The invention has the advantage that a high pressure is built up by a moulding in pressure nozzle form in the wedge-like narrowing flow gap between the pressure nozzle and the surface of the moulding on passing round the cylindrical body, whereby the liquid ink or the coating medium is pressed into the cups on the circumference of the engraved or coating roller and is continuously swirled in them.

By a sudden widening of the cross-section in the rotating direction of the cylindrical body behind the pressure nozzle, a sudden pressure drop is thereupon produced which results in the printing fluid compressed by the pressure nozzle and containing solvents and also mixed with air bubbles suddenly relaxing at the cylindrical body and thereby being again washed at least partly out of the cups or recesses in the surface of the body and being immediately refilled by the superimposed printing fluid, so that colour residues and impurities are continuously removed from the cups or recesses even in the area behind the pressure nozzle and are continuously carried off from the upper part of the ink chamber with the printing fluid.

The lower pressure in the rinsing chamber produced by the rebound and the sudden widening of the cross section behind the pressure nozzle has the further advantage that a negative doctor blade adjoining the ink chamber in the rotating direction of the cylindrical body is not arched outwards but instead lies with its knife-type blade-edge at all times smooth and flush along the circumference of the cylindrical body without any aquaplaning effect or increased wear occurring as in the state of the art. This results in an improved stripping by the negative doctor blade of the circumference of the roller. Moreover, the edge life of the doctor blade is quite appreciably extended.

The invention therefore has the advantage that the cups or recesses on the circumference of the cylindrical roller being washed out in depth by the increased pressure in the wedge-shaped narrowing pressure zone between the pressure nozzle and the surface of the body and by the subsequent sudden pressure drop with cavitation effect, which results in uniform inking of the engraved roller/gravure roller and consequently a constant ink intensity.

It is, further, specially advantageous for a uniform colour intensity if the distance between the pressure nozzle and the body surface of the circular cylindrical body is regulatable by means of an assembly mounting adjustable vertically to the rotary direction of the body on the doctor blade box, which has the further advantage that the pressure nozzle can easily be demounted from and refitted to the doctor blade box for cleaning the said box by means of the assembly mounting and cleaning of the doctor blade box is thereby in no way obstructed.

It is further an advantage to the uniform supply and distribution of the printing ink over the whole length of the ink chamber doctor blade if the forward chamber extending in front of the pressure nozzle in the direction of flow of the printing ink is sub-divided by a leading edge parallel to the cylindrical body into an injection chamber and a pre-washing chamber, linked to each other by a passage stretching across the whole length of the forward chamber between the leading edge and the lower side guards of the doctor blade box.

It is furthermore an advantage for the production and assembly of the ink chamber doctor blade for the doctor blade box to consist of a bottom with upper and lower lateral walls between end walls at each end and for horizontal and/or vertical bores to be provided as upper and lower inlets and outlets in the lower and upper side walls, from which a bore leads vertically or diagonally into the ink chamber in each case.

It is thereby structurally easily possible for an injection bore to be aligned from the inlet vertically opposite and injection duct extending along the bottom of the doctor blade box essentially throughout its length next to the leading edge, so that a particularly intimate mixing and uniform distribution of the printing ink can be achieved in the injection duct through the injection duct having a cross-section extending in a V-shape towards the ink chamber with a rounded bottom.

Also especially advantageous for this is the feature wherein the injection slot with the injection duct extending in a V-shaped cross-section is arranged and inclined against the bottom of the doctor blade box in such a way that the ink is conveyed beneath the leading edge limiting the injection duct sideways to the pre-rinsing chamber and against the circumference of the body. In a further detailed embodiment, the moulding includes a separate end wall coupled thereto which projects downwards through its length, leaving open an uniformly narrow longitudinal slot towards the lower sidewall of the doctor blade box for a uniform laminar through-flow of the ink from the injection of the distributing chamber into the pre-rinsing chamber which provides a yet greater blending of the supply of printing ink to the screened or engraved cylindrical body can be achieved. By this means the printing ink does not arrive immediately at the circumference of the cylindrical body but must first penetrate through a very narrow longitudinal slot approx. 1–2 mm wide beneath the separating wall in the lower part of the ink chamber with uniform laminar flow, in order from the injection chamber to reach the pre-washing chamber from which the printing ink then—as already described above, reaches the upper ink chamber through the wedge-shaped longitudinal slot passed the pressure nozzle on the moulding, with subsequent cavitation swirling.

The upper ink chamber can similarly be sub-divided by a vertical upper separating wall with a broad upper longitudinal slot into an upper subsequent rinsing chamber and a back-flow chamber, from which the printing fluid is returned to the ink pump through the outlets. The upper ink chamber is kept under continuous under-pressure by suction pipes for the ink so that no significant pressure can build up in the upper ink chamber. Nonetheless, the cavitation swirling and the continuous circulation of the printing fluid in the upper ink chamber ensures that the cups or recesses in the cylindrical body are kept filled adequately and uniformly.

The invention therefore has the advantage that the cups or recesses in the body surface are rinsed out in depth by the increased pressure in the wedge-shaped pressure zone and by the subsequent cavitation effect behind the pressure nozzle on the moulding, which results in very uniform inking of the screened or engraved body surface and a uniform ink intensity. Because of the laminar flow of the printing ink through the narrow lower longitudinal slot at the separating wall towards the pre-washing chamber, a uniform pre-washing of the cups on the circumference of the roller is also achieved.

Through the low pressure in the upper ink chamber, higher circumferential speeds can also be achieved with the engraved roller/gravure roller without a negative doctor blade set against the rotating direction of the cylindrical body losing its shape and lifting from the circumference of the engraved roller through an aquaplaning effect.

The invention is further aimed at still further improving a coating device of this kind so that gas bubbles contained in the ink or in the coating medium and in particular air bubbles washed out in the pre-washing chamber from the numerous small cups along the engraved roller by the ink newly supplied are already separated as the ink enters the wedge-shaped narrowing longitudinal slot between the high pressure doctor blade and the circumference of the roller and the ink thus cleaned arrives continuously on the circumference of the roller.

This is achieved in accordance with the present invention by fitting by-pass openings on the moulding next to the pressure nozzle between the pre-washing chamber and the after-rinsing chamber.

This makes it possible in a particularly advantageous way to have the ink circulate in the pre-washing chamber in such a way that gas bubbles present in the ink and air bubbles washed from the rotating roller are already separated from the ink on passing through the wedge-shaped narrowing flow slot between the moulding and the circumference of the roller and are removed through the by-pass openings between the pre-washing chamber and the after-rinsing chamber.

In a preferred embodiment of the invention, the moulding includes a ventilation slot stretching throughout its length between the pre-washing chamber and the after-rinsing chamber. It is advantageous in that case for separating the air and gas bubbles from the ink if a swirling gutter with a more or less arc-shaped cross-section is located at the inlet side of the venting slot.

The venting slot of the moulding in pressure nozzle and venting nozzle form is especially suitable for liquid inks that do not mix well with air. The ink rotates in the pre-washing chamber inversely to the direction in which the roller rotates. This forces the air from the cups on the circumference of the roller which is then necessarily carried to the inlet of the venting slot where the air bubbles are separated from the ink which moves in wave form and escape through the venting slot into the after-rinsing chamber and on to the outlet of the ink chamber.

The removal of the air and gas bubbles from the ink has the advantage that the ink on the engraved roller will not foam. Each cup on the circumference of the engraved roller is filled without admixture of air so that a better quality printed image is achieved. The drying of the ink in the cups on the engraved roller is also opposed, which also helps to prevent printing errors. Furthermore, air and gas bubbles must be removed from certain printing fluids in order to prevent oxidation of the fluid.

The separation of gas and air bubbles from the ink can be yet further improved by locating a venting edge parallel to the inlet at the venting slot at the transition from the swirling gutter to the venting slot which separates the air and gas bubbles absorbed from the rotating ink in the pre-wash chamber from the ink arriving and diverts it to the venting slot.

The rising gas and air bubbles can then escape upwards through the venting slot that advantageously opens into the after-rinsing chamber in a volted area at the top of the moulding.

To reduce the consumption of ink and to make best possible use of the ink circulating it may be advantageous for a by-pass slot to be fitted between the bottom of the ink chamber and the back of the moulding to return the ink from the after-rinsing chamber to the pre-washing chamber.

Especially advantageous further developments of the invention appear in the following detailed description of the preferred embodiments.

BRIEF DESCRIPTION OF THE DRAWINGS

Preferred embodiments of the invention are illustrated diagrammatically in the drawing. Here.

DESCRIPTION OF THE PREFERRED EMBODIMENTS

Figure 1:
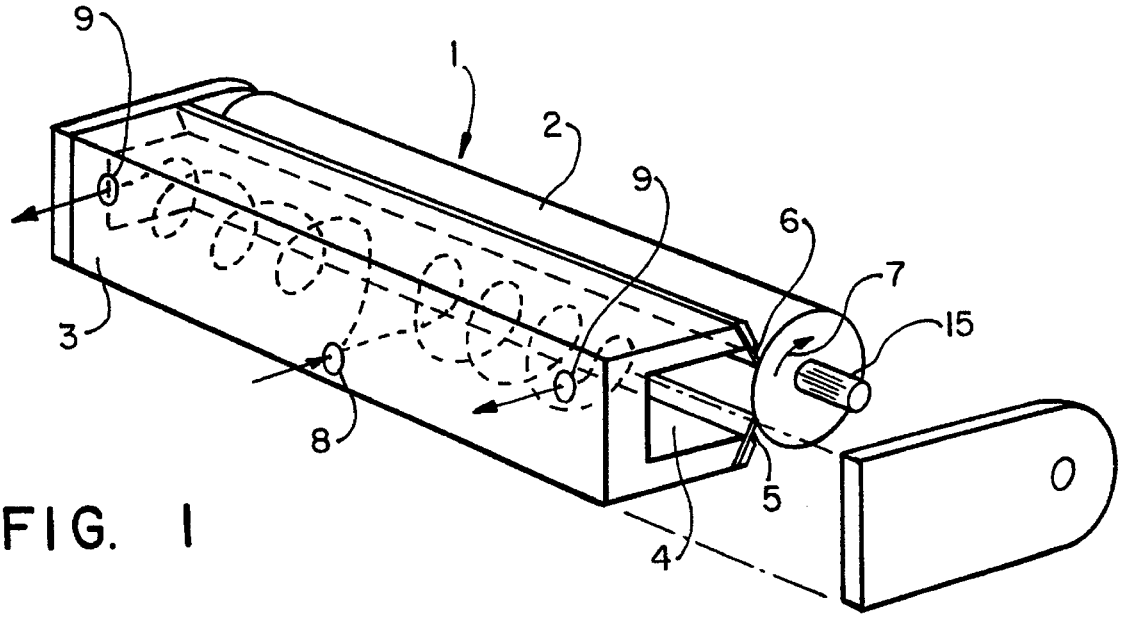
FIG. 1 is a space diagram of an ink chamber doctor blade for flexographic presses/gravure presses with engraved drum/gravure drum and positive doctor blade and negative doctor blade.

The ink chamber doctor blade 1 shown in FIG. 1 for doctor blade printing mechanisms with engraved roller/gravure roller on flexographic presses/gravure presses consists of a doctor blade box 3 with an ink chamber 4 and a positive doctor blade 5 and a negative doctor blade 6, the doctor blade or knife sides of which lie against the circumference of an inking, screened circular cylindrical body 2 turning in the direction of arrow 7. The ink chamber 4 has an inlet 8 at centre bottom and two upper outlets 9 for the forced circulation of the liquid ink by an ink pump, not shown.

As is evident from FIGS. 2 to 9 in detail, the ink chamber doctor blades 1 shown there in cross section in ink chamber 4 display a moulding 11 fitted with a pressure nozzle 10 between positive doctor blade 5 and negative blade 6 which extends over the whole length of the circular cylindrical body 2 and forms an increasingly narrowing wedge-shaped flow gap 12 in the direction of rotation 7 of the body 2, whereby the pressure nozzle 10 is arranged at such a small distance from the surface of the body 2 that liquid pressure builds up in the flow gap 12 and as the cylindrical body 2 revolves the ink passing the pressure nozzle 10 can reach the upper part of ink chamber 4, which serves as an after-rinsing chamber, located behind the moulding 11.

The moulding 11 is formed with a sharp-edged rebound 14 in the direction of rotation 7 behind the pressure nozzle 10 for a sudden expansion of the cross-section to produce a sudden pressure drop in the liquid emerging from the flow gap 12.

Figure 2:
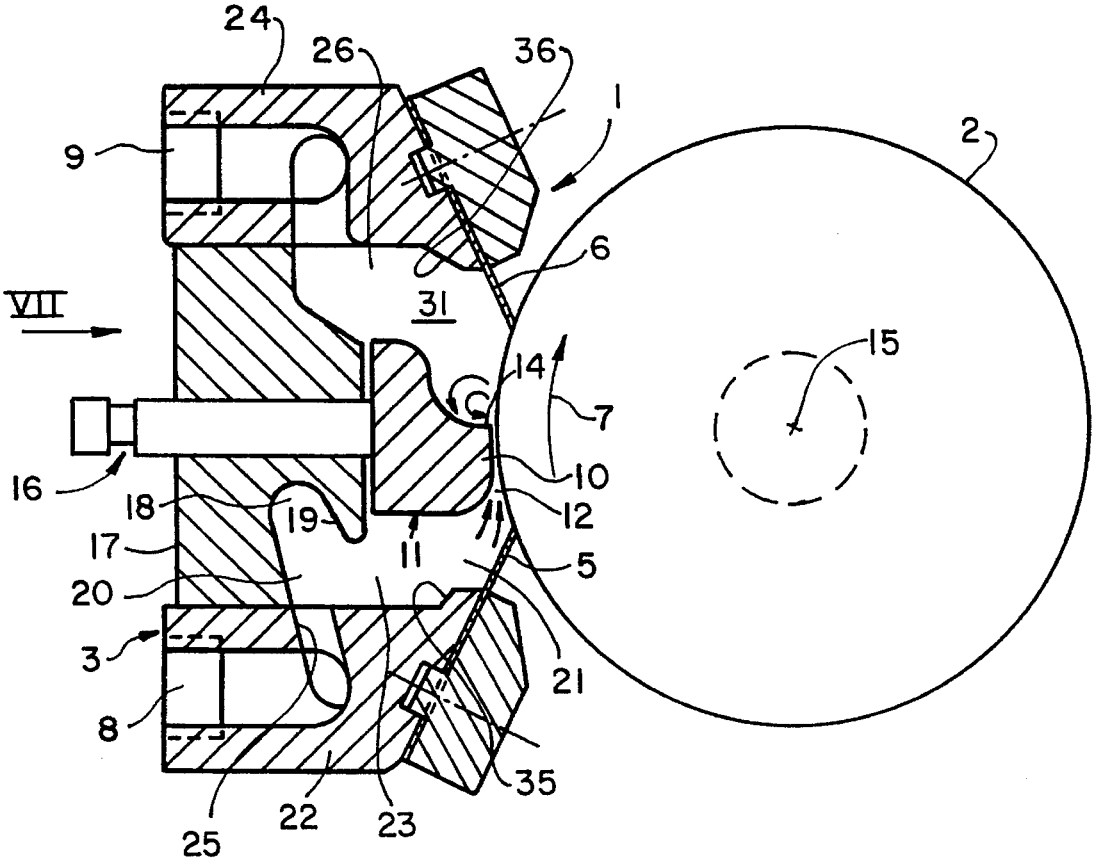
FIG. 2 is a vertical section through an initial embodiment of such an ink chamber doctor blade with a moulding displaying a pressure nozzle in the ink chamber.
Figure 3:
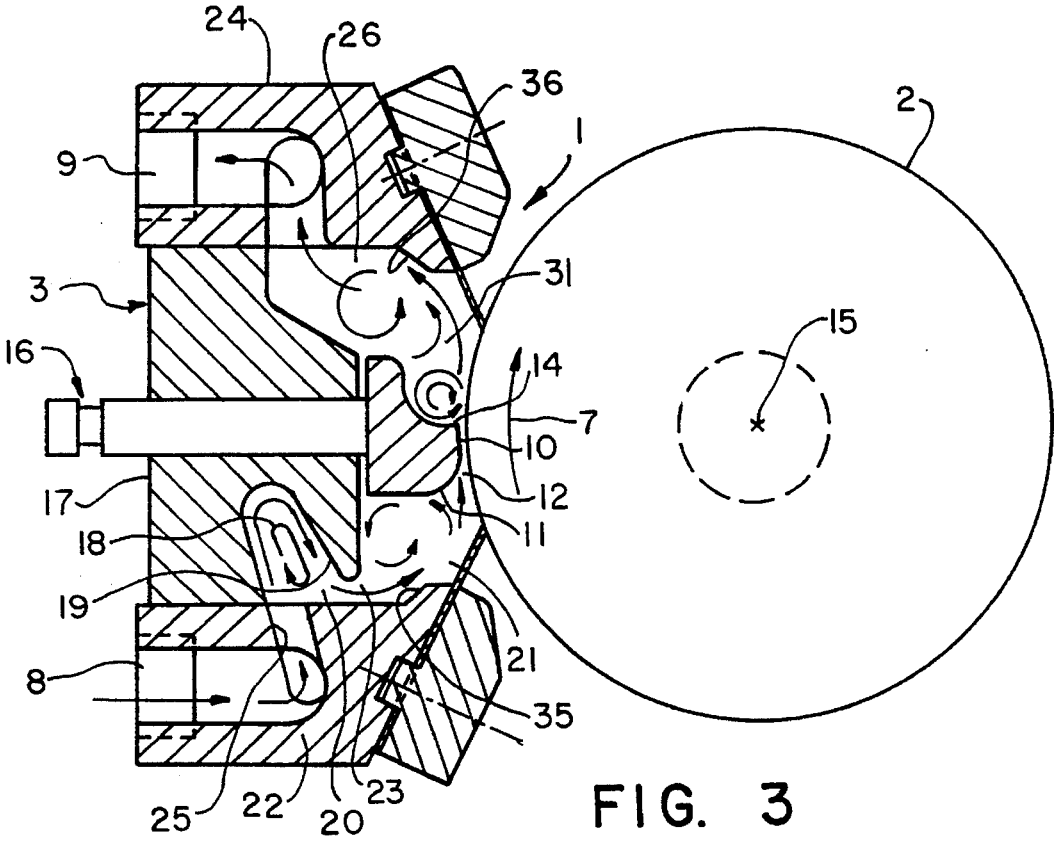
FIG. 3 is a section analogous to FIG. 2 through an ink chamber doctor blade of that kind with ink flowing through during operation.
Figure 4:
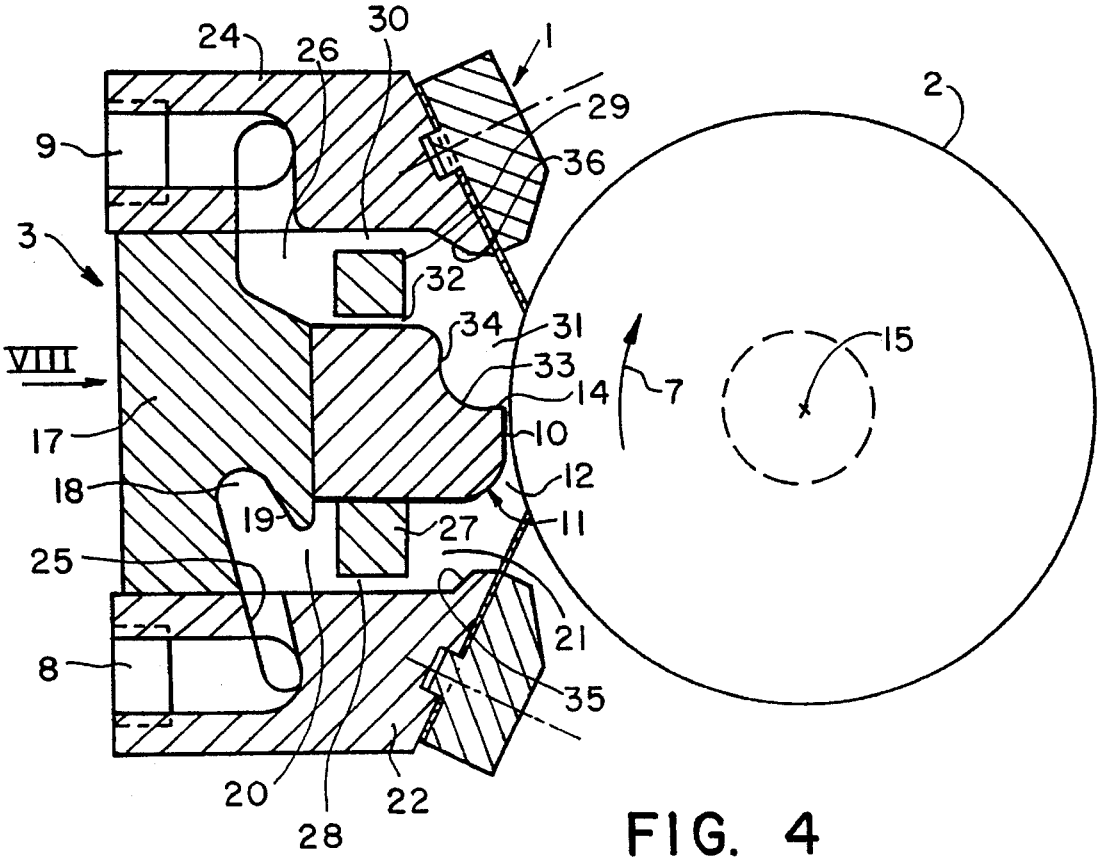
FIG. 4 is a section through an embodiment further modified as against FIG. 2 and 3 of an ink chamber doctor blade of that kind.

The distance of the pressure nozzle 10 from the circumference of the circular cylindrical body 2 can be regulated in the embodiments in FIGS. 2, 3, 5, 6 and 9 by an assembly mounting 16 on the doctor blade box 3 adjustable at right angles to the axis of rotation 15 while in the simplified embodiment in FIG. 4 the moulding 11 is permanently fitted to the bottom 17 of the doctor blade box 3 so that the distance from the pressure nozzle 10 to the circumference of the circular cylindrical body 2 is constant and cannot be changed.

In the two embodiments in FIGS. 2 and 3, the ink chamber 4 is equipped at the back-wall of the doctor blade box 3 above the lower inlet 8 for the ink with a horizontal injection duct 18 which is limited by a leading edge 19, parallel to the circular cylindrical body 2 and pointing diagonally downwards. The leading edge 19 divides the forward chamber extending in front of the moulding 11 in the direction of flow of the ink into an injection chamber 20 and a pre-wash chamber 21, which are linked to each other by a passage 23 extending over the entire length of the forward chamber between the leading edge 19 and the lower side wall 22 of the doctor blade box 3. This passage 23 can be of wider or narrower dimensions by forming the leading edge 19 appropriately, as shown in FIGS. 2 and 3.

As is clear from the sectional drawings of FIGS. 2 to 6 and 9, the doctor blade box 3 is composed of a bottom 17 with lower and upper side walls 22, 24 and end walls at each end. Horizontal and/or vertical bores are fitted as lower and upper inlets and outlets 8, 9 in the upper and lower side walls 22, 24, of which a vertical and a diagonal bore in each case leads to the ink chamber 4.

From the inlet bore 8, an injection bore or an injection slot 25 is directed at right angles to the injection duct 18, which extends along the bottom 17 of the doctor blade box 3 mostly over its entire length next to the leading edge 19. The injection duct 18 has a cross section widening in a V-shape towards the ink chamber 4 with a rounded bottom and the injection bore or the injection slot 25 is arranged with the injection duct extending with a V-shaped cross section inclined in such a way against the bottom 17 of the doctor blade box 3 that the ink mixed in the injection duct 18 is conveyed underneath the leading edge 19 limiting the injection duct at the side into the pre-wash chamber 21 and against the circumference of the engraved roller 2.

This arrangement of the injection or distribution chamber 20 means that the ink is distributed over the whole length of the doctor blade box 3 after entering into the lower central inlet 8 and being conveyed through the injection bore or the injection slot 25 and the injection duct 18 to both sides of the injection chamber 20 and is then mixed more or less helically in the injection duct extending above the opening of the injection bore 25, subsequently entering between the front leading edge 19 and the lower side wall 22 of the doctor blade box 3 into the pre-wash chamber 21 located in front of it, where it is mixed further, in order then to be drawn from the circulating circular cylindrical body 2 into the narrow flow gap 12 between the circumference of the roller and the longitudinal edge of the pressure nozzle 10 parallel with it, whereupon the ink is pressed through the pressure build-up into the increasingly narrowing flow gap 12 into the cups on the circumference of the engraved roller and is uniformly mixed.

As further shown in FIGS. 2 and 3, the ink after passing through the narrow flow gap 12 enters the area of the rebound 14 where a sudden, abrupt pressure drop occurs, through which the ink is swirled in such a way by a kind of cavitation effect that a wash-out effect is produced in the cups or recesses of the circular cylindrical body 2 which leads to a further replacement of the ink in the cups which then as the roller turns further arrive beneath the negative doctor blade 6 and are relieved by it of surplus ink in the bridge areas.

As is evident in particular from the illustration in FIG. 3, the cavitation effect behind the pressure nozzle 10 produces an under-pressure in the return chamber 26 or at least so low a pressure that distortion of the negative doctor blade 6 is prevented before the ink is removed through the two upper outlets 9 and is again available for renewed injection into the ink chamber 4 after passing through a filter.

Figure 5:
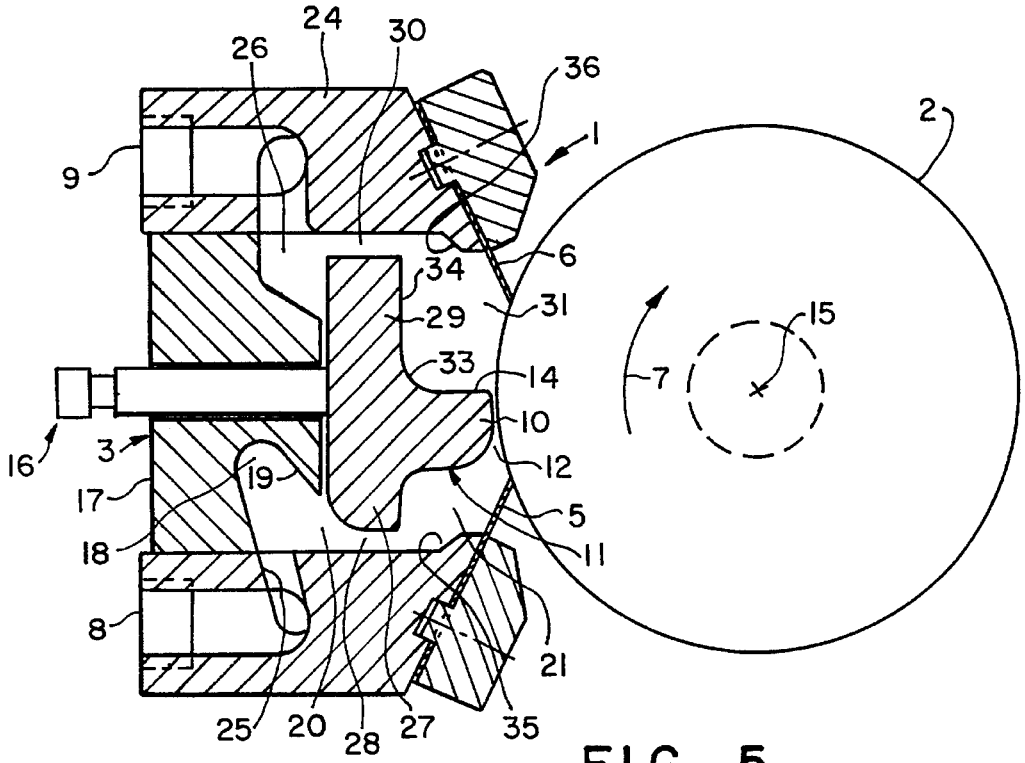
FIGS. 5 and 6 are each sections through an embodiment further modified in details of such ink doctor blades.
Figure 6:
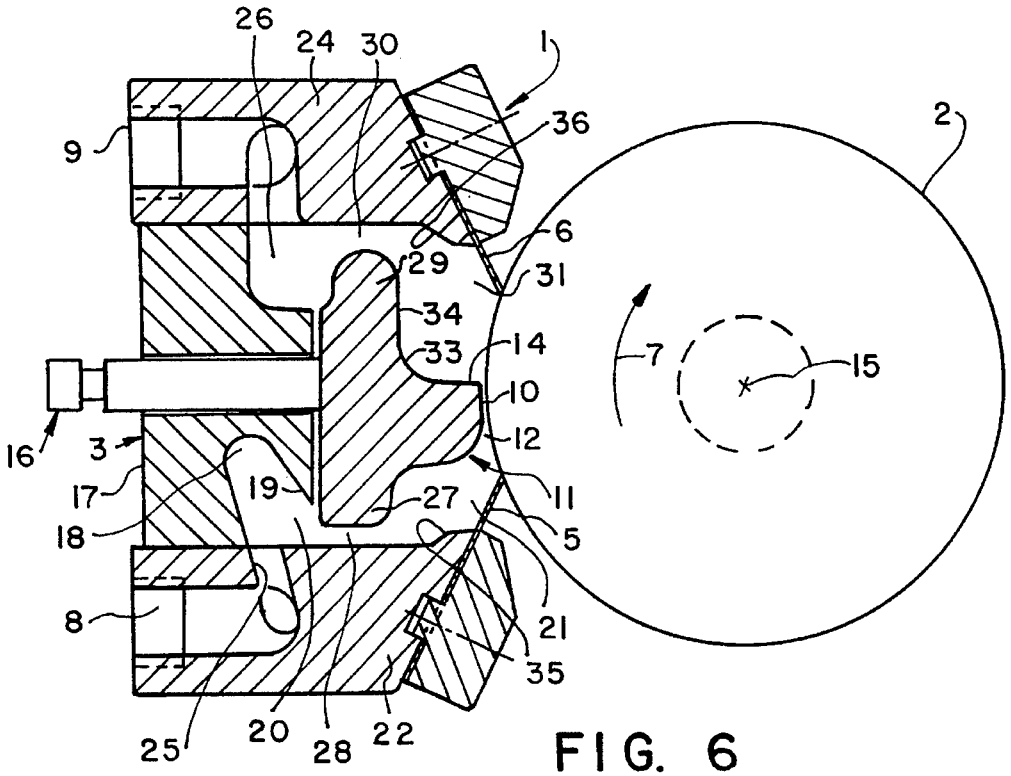
Figure 7:
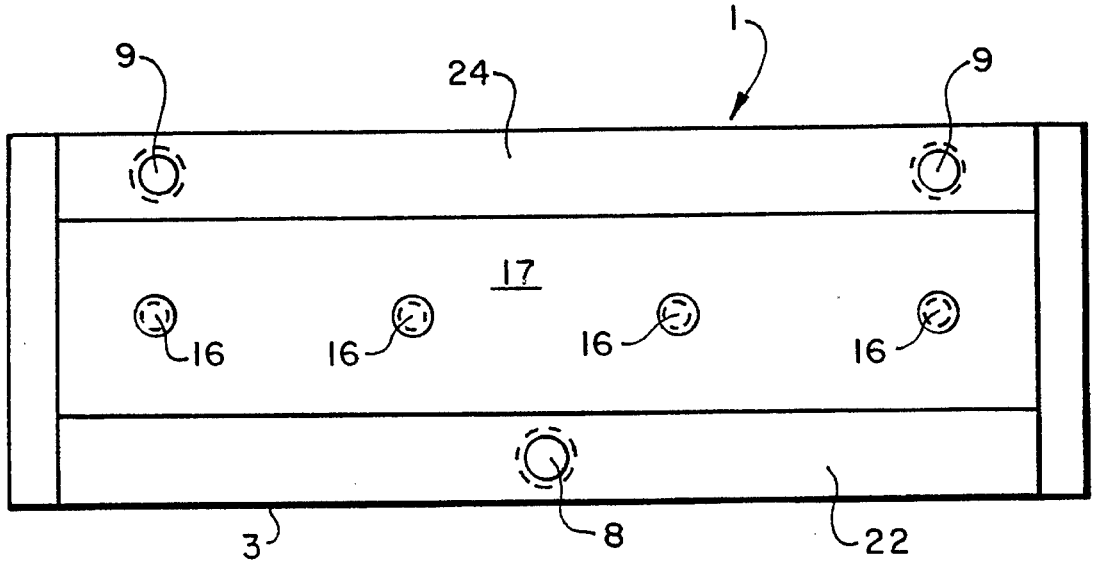
FIG. 7 is a rear view of the doctor blade box of the ink chamber doctor blade in the direction of arrow VII in FIG. 2.
Figure 8:
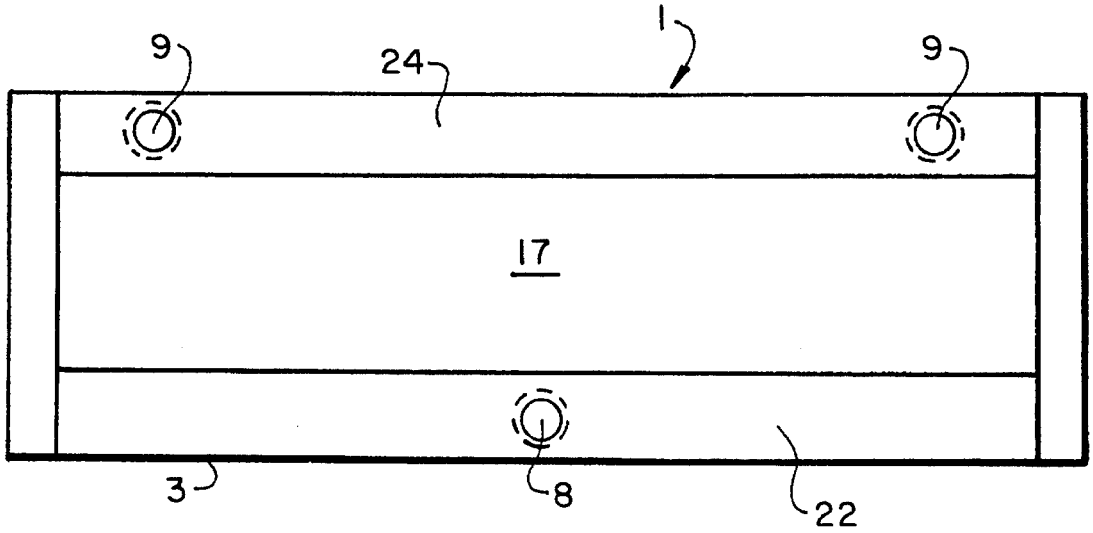
FIG. 8 is a rear of the modified embodiment of the ink chamber doctor blade in the direction of arrow VIII in FIG. 4

Further to the two embodiments of FIGS. 2 and 3, as shown in FIGS. 4 to 6, a separating wall 27 may project downwards from the mobile 11 for the whole of its length and fasten thereto or forming one piece with it, which leaves open a uniformly narrow longitudinal slot 28 beneath the side wall 22 of the doctor blade box 3 for laminar flow of the liquid ink from the injection or distribution chamber 20 into the pre-wash chamber 21.

In addition, with these modified embodiments, an upper separating wall 29 may also project upwards from the moulding 11 for the whole of its length, similarly leaving open a longitudinal slot 30 against the upper side wall 24 of the doctor blade box 3 for laminar flow of the stripped ink, forming an after-rinsing chamber 31 behind the return chamber 26.

As shown in FIG. 4, where the lower and upper separating walls 27, 29 are subsequently fastened to the moulding 11, the upper separating wall 29 may also leave open a return slot 32 for the circulation and additional swirling of the ink stripped from the body 2 between return chamber 26 and after-rinsing chamber 31.

Instead of the embodiment shown in FIG. 4, the moulding 11 may, however, form one piece with the lower separating wall 27 and also with the upper separating wall 29, as FIGS. 5 and 6 show, whereby the projecting walls 27, 29 projecting downwards and upwards from the moulding 11 may display angular or rounded longitudinal edges in accordance with FIGS. 5 or 6.

In all the embodiments shown, the sharp-edged rebound 14 is rounded more or less in an arc behind the pressure nozzle 10 and when joining the rounding 33 is transformed into a wall section 34 rising more or less tangentially and displaced in parallel to the circumference of the circular cylindrical body 2. Flow deflectors 35, 36 for the ink are arranged in the form of enhanced longitudinal edges next to the positive doctor blade 5 and also next to the negative doctor blade 6, which also further help to reduce the liquid pressure against the inner edge of the doctor blade knife.

Figure 9:
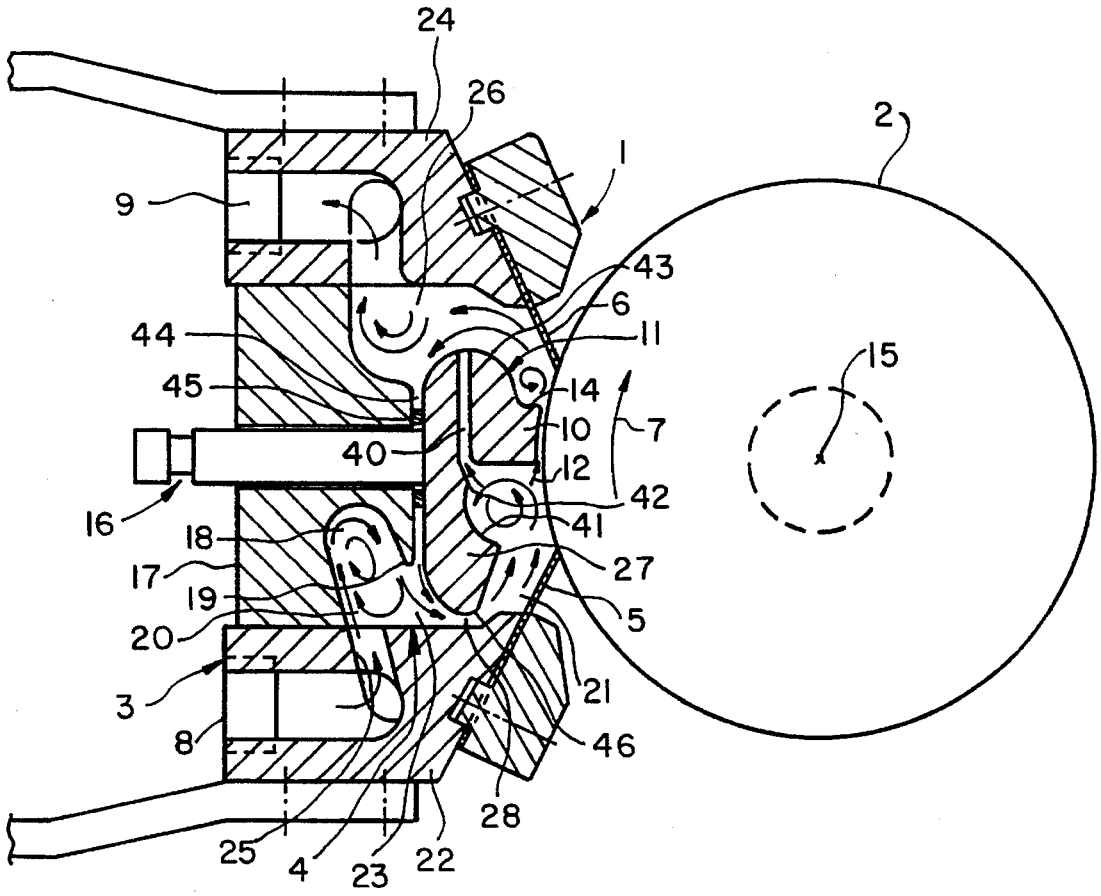
FIG. 9 is a horizontal section through a yet further modified embodiment of an ink chamber doctor blade.

In the further developed embodiment of FIG. 9, by-pass openings exist next to the pressure nozzle between the pre-wash chamber 21 and the after-rinsing chamber 31 to improve cleaning of gas and air bubbles from the ink and to improve circulation of the ink in the ink chamber doctor blade 1 at the moulding 11.

The moulding 11 displays a venting slot 40 expanding for the whole of its length between the pre-wash chamber 21 and the after-rinsing chamber 31 and is equipped at the inlet side of the venting slot 40 with a swirling gutter shaped more or less like an arc in cross-section.

The transition of the swirling gutter 41 with the venting slot 40 a venting edge 42 extends in parallel with the inlet of the venting slot, which separates the air and gas bubbles absorbed in the pre-wash chamber 21 from rotating ink and guides them to the venting slot 40. The venting slot 40 opens out into the after-rinsing chamber 31 in a vaulted area 43 at the upper side of the moulding 11.

A bypass slot 44 is located between the bottom 17 of the ink chamber 4 and the back of the moulding 11 to return ink from the after-rinsing chamber 31 to the pre-wash chamber 21. The width of this bypass slot may for example be changed by the assembly mounting 16 for the moulding 11 and retained by spacer rings 45 on the bolt for the assembly mounting 16.

The moulding 11 further has a separating wall 27 projecting into the pre-wash chamber 21, the lower longitudinal edge 46 of which runs at a small lateral distance in parallel with the inside of the lower side wall 22 of ink chamber 4, and leaves an opening narrowing and again widening in the nature of a venturi valve in the flow direction of the ink (longitudinal slot 28) to the pre-wash chamber 21.

Especially good flow is achieved if the lower separating wall 27 of the profile body 11 adjoining the bypass slot 44 slopes away in the direction of flow of the ink towards the pre-wash chamber 21 and is rounded as against the inside of the lower side wall 22 of the ink chamber 4.

The flow in the pre-wash chamber 21 may be further improved if the lower separating wall 27 of the moulding 11 is so inclined as against the positive doctor blade 5 that the pre-wash chamber 21 displays a gradually widening cross section in the direction of flow of the ink.

In all the embodiments shown, the doctor blades adjoining the ink chamber 4 in the circumferential direction of the circular cylindrical body 2 may take the form of negative doctor blades instead of positive doctor blades 5 or of positive doctor blades instead of the negative doctor blades 6, entirely according to the various coating requirements made.

As with doctor blade presses, chamber doctor blades of this kind can also be advantageously used for applying thin layers of adhesive to strip material and for applying magnetic coatings to tape material for recording tapes and video cassettes and for other comparable coating purposes.

List of reference symbols

1. Ink chamber doctor blade
2. Circular cylindrical body
3. Doctor blade box
4. Ink chamber
5. Positive doctor blade
6. Negative doctor blade
7. Direction of rotation
8. Inlet
9. Outlet
10. Pressure nozzle
11. Moulding
12. Flow gap
14. Rebound
15. Axis of rotation
16. Assembly mounting
17. Bottle
18. Injection duct
19. Leading edge
20. Injection chamber
21. Pre-washing chamber
22. Lower side wall
23. Passage
24. Upper side wall
25. Injection bore/Injection slot
26. Return chamber
27. Lower separating wall
28. Longitudinal slot
29. Upper separating wall
30. Longitudinal slot
31. After-rinsing chamber
32. Return slot
33. Rounding
34. Wall section
35. Flow deflection (Positive doctor blade)
36. Flow deflection (Negative doctor blade)
40. Venting slot
41. Swirling gutter
42. Venting edge
43. Vaulted area
44. Bypass slot
45. Spacer ring
46. Longitudinal edge

What is claimed is:

1. A device for coating moving material strips on a cylindrical body, comprising:

a doctor blade box having an upper side wall, a lower side wall, end walls, a bottom, a liquid inlet and a liquid outlet;

a liquid chamber formed by said side walls and the bottom of the doctor blade box and located adjacent the cylindrical body;

a device for liquid supply to said liquid chamber;

a device for liquid removal from said liquid chamber; and an axially extending moulding mounted in the liquid chamber between the liquid inlet and the liquid outlet of the doctor blade box, wherein the moulding includes a pressure nozzle, wherein the pressure nozzle is arranged at a distance from a surface of the cylindrical body and forms an axially extended flow gap between the pressure nozzle and the surface of the cylindrical body, wherein the pressure nozzle includes a rebound on a liquid outlet side of the pressure nozzle as defined by a direction of rotation of the cylindrical body, wherein the rebound includes a rounded portion adjacent an outlet of the flow gap and wherein the rebound includes a wall section extending upwards from the rounded portion and substantially tangentially to the surface of the cylindrical body, such that a sudden expansion of a cross section of the flow gap is produced by the rebound to produce a sudden pressure drop in an area of the liquid chamber behind the pressure nozzle as defined in a direction of rotation of the cylindrical body.

2. The device as claimed in claim 1, further including means for adjusting a distance between the pressure nozzle and the surface of the cylindrical body.

3. The device as claimed in claim 2, further including a forward chamber extending in a through-flow direction of the liquid in front of the pressure nozzle, wherein the forward chamber includes a leading edge and wherein the leading edge divides the forward chamber into an injection chamber and a pre-washing chamber, wherein the injection chamber and pre-washing chamber are connected to each other by a passage extending over substantially the entire length of the forward chamber between the leading edge and the lower side wall of the doctor blade box.

4. The device as claimed in claim 3, wherein the doctor blade box further includes at least one bore located in each of the lower and upper side walls and wherein each said at least one bore leads into the liquid chamber.

5. The device as claimed in claim 3, further including an injection slot arranged adjacent and in flow communication with the liquid inlet, wherein the injection slot is arranged at right angles to an injection duct and in flow communication therewith, wherein the injection duct extends along the bottom of the doctor blade box substantially for its entire length and wherein the injection duct is adjacent the leading edge.

6. The device as claimed in claim 5, wherein the injection duct has a rounded bottom and a V-shaped cross section.

7. The device as claimed in claim 6, wherein the injection slot and the injection duct are configured such that the liquid is conveyed from the injection duct beneath the leading edge to the pre-washing chamber, wherein the pre-washing chamber is located adjacent the surface of the cylindrical body and wherein the injection duct is in liquid communication with the pre-washing chamber.

8. The device as claimed in claim 5, wherein the moulding further includes a lower separating wall projecting downwards therefrom throughout substantially its entire length such that a substantially uniformly narrow longitudinal slot is formed towards the lower side wall of the doctor blade box for producing a substantially uniform laminar through-flow of the liquid from the injection duct to the pre-washing chamber located adjacent the surface of the cylindrical body.

9. The device as claimed in claim 7, further including an upper separating wall projecting upwards from the moulding throughout substantially its entire length such that a substantially longitudinal slot is formed adjacent the upper side wall of the doctor blade box for producing a substantially uniform laminar through-flow of liquid stripped from the cylindrical body, and wherein the upper separating wall divides the ink chamber above the moulding into an after-rinsing chamber and a return chamber.

10. The device as claimed in claim 9, further including a return slot in the upper separating wall extending between the return chamber and after-rinsing chamber for circulating the liquid stripped from the body between the return chamber and after-rinsing chamber.

11. The device as claimed in claim 9, further including a lower separating wall extending downwards from the moulding and wherein the upper and lower separating walls have angular longitudinal edges.

12. The device as claimed in claim 9, further including a lower separating wall extending downwards from the moulding and wherein the upper and lower separating walls have rounded longitudinal edges.

13. The device as claimed in claim 2, further including flow deflectors for the liquid, wherein at least one flow detector is located on each of the upper and lower side walls of the doctor blade box adjacent a positive doctor blade and a negative doctor blade, respectively.

14. The device as claimed in claim 1, wherein the cylindrical body is a gravure roller.

15. The device as claimed in claim 9, further including a bypass slot located in the moulding adjacent the pressure nozzle, wherein the bypass slot extends between the pre-washing chamber and the after-rinsing chamber.

16. The device as claimed in claim 9, wherein the moulding further includes a venting slot extending throughout its length between the pre-washing chamber and the after-rinsing chamber.

17. The device as claimed in claim 16, wherein the moulding further includes a swirling gutter having a substantially arc-shaped cross section, wherein the swirling gutter is located at a liquid inlet side of the venting slot.

18. The device as claimed in claim 17, wherein the venting slot further includes a venting edge located at a transition region from the swirling gutter to the venting slot, wherein the venting edge diverts air and gas bubbles from rotating liquid in the pre-washing chamber to the venting slot.

19. The device as claimed in claim 16, wherein the after-rinsing chamber includes a vaulted area.

20. The device as claimed in claim 18, further including a bypass slot located between a bottom of the doctor blade box and a back of the moulding, wherein the bypass slot extends between the after-rinsing chamber and the pre-washing chamber to return the liquid from the after-rinsing chamber to the pre-washing chamber.

21. The device as claimed in claim 20, further including means for adjusting the width of the bypass slot.

22. The device as claimed in claim 21, wherein the moulding further includes a lower separating wall projecting into the pre-washing chamber, wherein the lower separating wall includes a lower longitudinal edge running at a small lateral distance substantially parallel with an inner side of the lower side wall of the doctor blade box and forms an opening into the pre-washing chamber, wherein the opening is configured as a venturi valve in a through-flow direction of the liquid.

23. The device as claimed in claim 20, wherein the moulding further includes a lower separating wall, and wherein a portion of the lower separating wall is disposed at an angle to the pre-washing chamber adjoining the bypass slot.

24. The device as claimed in claim 22, wherein the lower longitudinal edge of the lower separating wall has a rounded portion adjacent the lower side wall of the doctor blade box.

25. The device as claimed in claim 24, wherein a portion of the lower separating wall is inclined and wherein the pre-washing chamber is located between a positive doctor blade and the lower separation wall such that the pre-washing chamber displays a gradually widening cross section in a direction of flow of the liquid.

* * * * *